US009142906B2

(12) United States Patent
Chou et al.

(10) Patent No.: US 9,142,906 B2
(45) Date of Patent: Sep. 22, 2015

(54) POWER PLUG CAPABLE OF SIMPLE ASSEMBLY

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Che-Yu Chou, New Taipei (TW); Qun Huang, Shenzhen (CN); Tai-Shan Zhu, Shenzhen (CN); Tao Jiang, Shenzhen (CN); Wen-Chih Lan, New Taipei (TW); Jun-Liang Zhang, Shenzhen (CN); Ji-Bing Guo, Shenzhen (CN); Hua-Yong Wang, Shenzhen (CN); Zhi-Jun Shi, Shenzhen (CN); Wei-Wei Yu, Shenzhen (CN); Hai-Qian Ge, Shenzhen (CN); Zhou Chen, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 182 days.

(21) Appl. No.: 13/941,571

(22) Filed: Jul. 15, 2013

(65) Prior Publication Data

US 2014/0073200 A1 Mar. 13, 2014

(30) Foreign Application Priority Data

Sep. 12, 2012 (CN) ..... 2012 1 0335907

(51) Int. Cl.

| | |
|---|---|
| ***H01R 13/04*** | (2006.01) |
| ***H01R 13/46*** | (2006.01) |
| ***H01R 9/20*** | (2006.01) |
| ***H01R 13/502*** | (2006.01) |
| *H01R 103/00* | (2006.01) |
| *H01R 31/06* | (2006.01) |

(52) U.S. Cl.

CPC ..... *H01R 13/46* (2013.01); *H01R 9/20* (2013.01); *H01R 13/502* (2013.01); *H01R 31/06* (2013.01); *H01R 2103/00* (2013.01)

(58) Field of Classification Search

CPC ..... H01R 13/46; H01R 9/20; H01R 13/502; H01R 2103/00; H01R 31/06

USPC ..... 439/692

See application file for complete search history.

(56) References Cited

U.S. PATENT DOCUMENTS 5,482,478 A * 1/1996 Liao ..... 439/620.29

* cited by examiner

*Primary Examiner* — Javaid Nasri

(74) *Attorney, Agent, or Firm* — Novak Druce Connolly Bove + Quigg LLP

(57) ABSTRACT

A power plug for connecting with a power outlet includes at least two metal connecting poles, two outputting cavities, and two conductive resilient sheets. The two outputting cavities are defined in a lower case of the power plug to connect an external device. The two conductive resilient sheets are received within an inner space of the power plug. The at least two metal connecting poles pass through an exterior surface of the power plug into the internal space to form two connecting terminals. Each of the conductive resilient sheets is connected between one of the two connecting terminals and a corresponding outputting cavity to transport electrical power from the power jack to the external device.

20 Claims, 6 Drawing Sheets

POWER PLUG CAPABLE OF SIMPLE ASSEMBLY

BACKGROUND

1. Technical Field

The present disclosure generally relates to power connectors, and more specifically relates to a power plug.

2. Description of Related Art

A three-pole power plug includes an upper case and a lower case coupled with the upper case to form a receiving space. The upper case includes a positive terminal, a negative terminal and a ground terminal to electrically connect to a corresponding power jack. The lower case includes two outputting terminals respectively connect to the positive terminal and the negative terminal through connecting wires. A part of the connecting wires are packaged in the receiving space of the power plug. During an assemble process of the power plug, the connecting wires are respectively connected to the positive terminal, the negative terminal and the outputting terminals by means of soldering. However, it is inconvenient to assemble the power plug by soldering.

Therefore, a heretofore unaddressed need exits in the industry to overcome the aforementioned deficiency.

BRIEF DESCRIPTION OF THE DRAWINGS

The components in the drawings are not necessarily drawn to scale, the emphasis instead being placed upon clearly illustrating the principles of the plug. Moreover, in the drawings, like reference numerals designate corresponding parts throughout the several views.

DETAILED DESCRIPTION

Embodiments of the present disclosure will be described with reference to the accompanying drawings.

Figure 1:
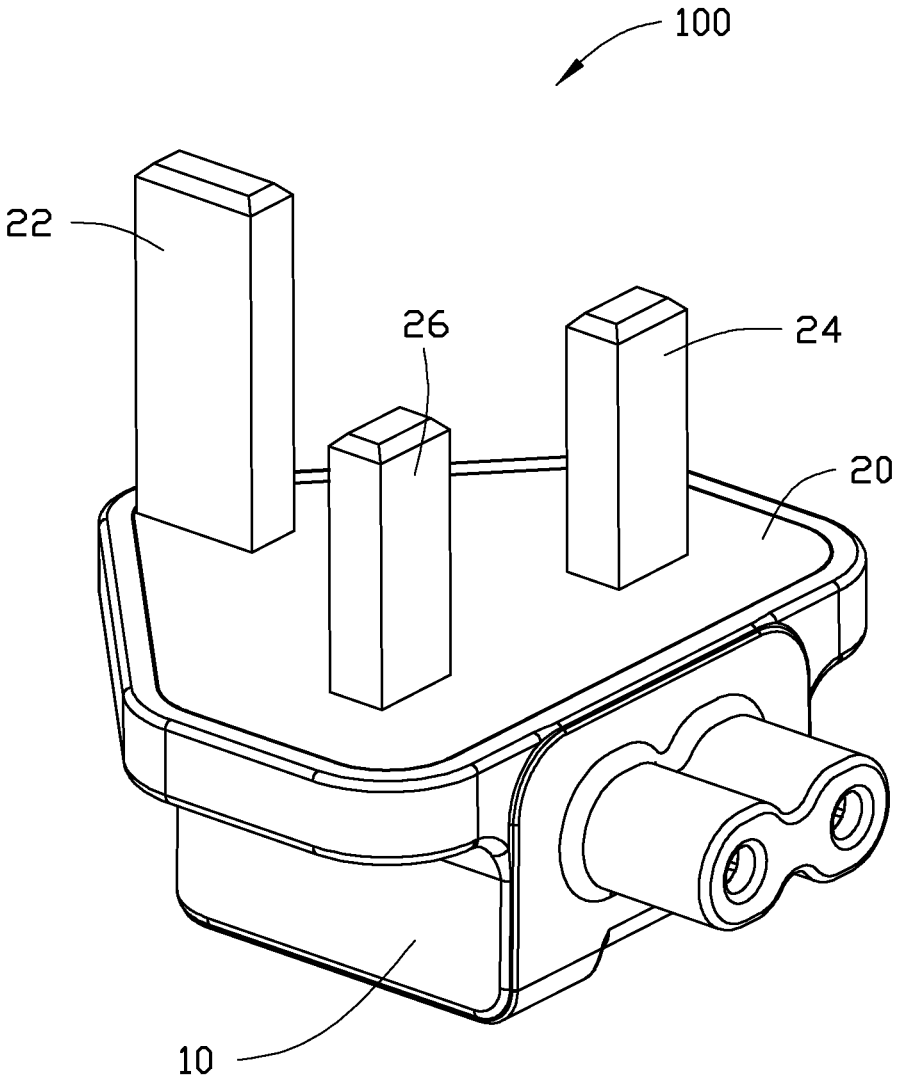
FIG. 1 is an isometric view of a power plug in accordance with an embodiment.

Referring to FIG. 1, an isometric view of a power plug 100 in accordance with an embodiment is shown. In the embodiment, the power plug 100 is a three-pole power plug. In other embodiments, the power plug 100 may be a two-pole power plug.

Figure 2:
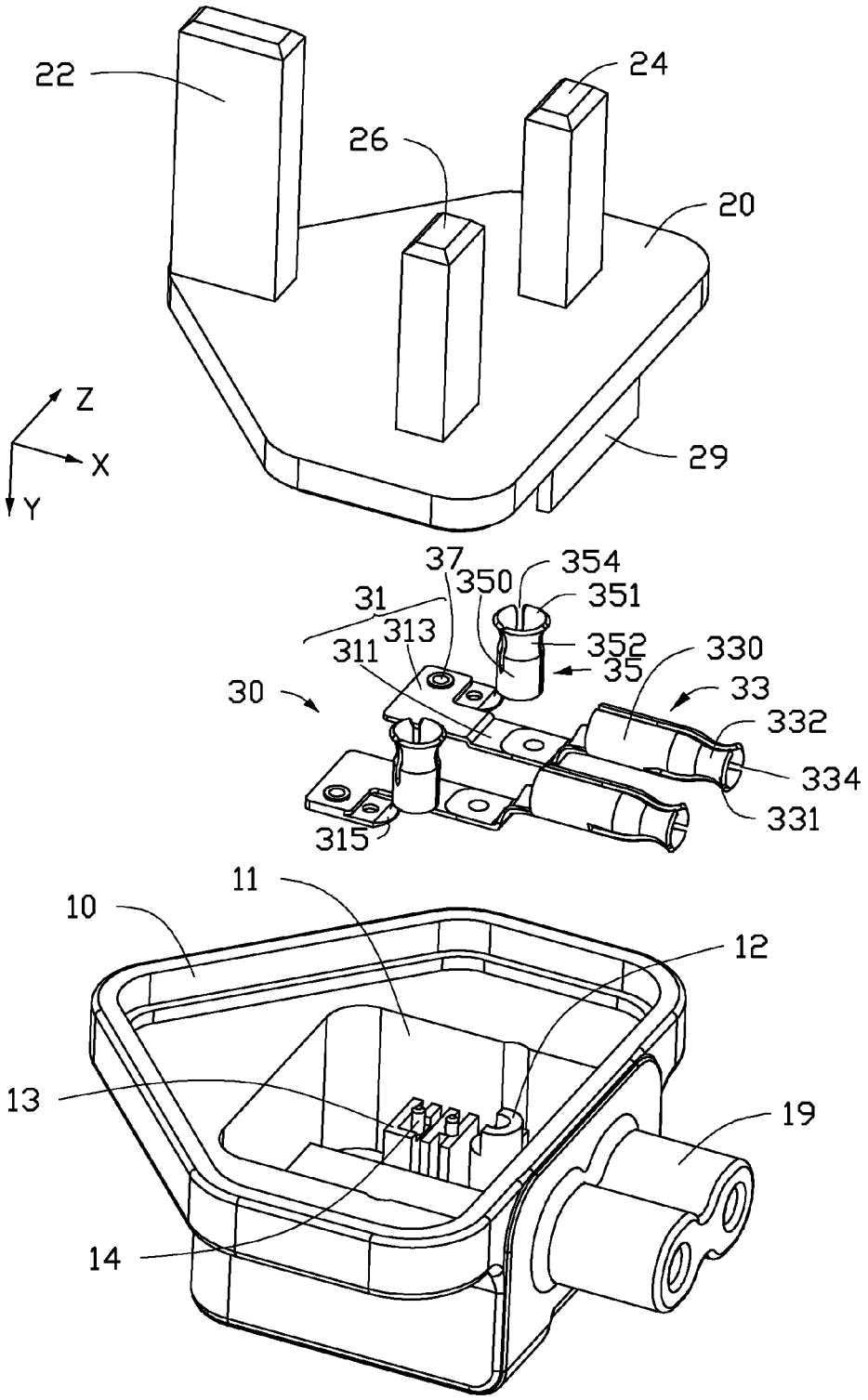
FIG. 2 is an exploded, isometric view of the power plug of FIG. 1, viewed from a first direction.

Further referring to FIG. 2, an exploded, isometric view of the power plug 100 viewed from a first direction is shown. In this embodiment, the power plug 100 includes a lower case 10, an upper case 20 coupled with the lower case 10 to define a receiving space (not labeled), and two conductive resilient sheets 30 received in the receiving space. The upper case 20 includes a first connecting pole 22, a second connecting pole 24 and a third connecting pole 26. In this embodiment, the first connecting pole 22 is a ground pole of the power plug 100, the second connecting pole 24 is a positive conductive pole, and the third connecting pole 26 is a negative conductive pole. The first connecting pole 22, the second connecting pole 24 and the third connecting pole 26 are configured to connect to a power jack (not labeled), wherein the first connecting pole 22 connects to a ground (GND) terminal of the power jack. In the embodiment, the second connecting pole 24 and the third connecting pole 26 are defined on the upper case 20 and aligned with each other. The first connecting pole 22 is defined on the upper case 20 away from the second connecting pole 24 and the third connecting pole 26. The first connecting pole 22, the second connecting pole 24 and the third connecting pole 26 are perpendicularly to the face of the upper case 20.

In the embodiment, each of the first connecting pole 22, the second connecting pole 24 and the third connecting pole 26 is a cuboid-shaped metal sheet. Each of the first connecting pole 22, the second connecting pole 24 and the third connecting pole 26 has a first distal end away from the upper case 20 and an opposite second end embedded in the upper case 20. The diameter of the first distal end is smaller than that of the second end. Such that the first connecting pole 22, the second connecting pole 24 and the third connecting pole 26 can be easily inserted into the power jack. The length of the first connecting pole 22 is greater than that of the second connecting pole 24 and the third connecting pole 26. When the power plug 100 is inserted into the jack, the first connecting pole 22 is firstly contacted to the ground terminal of the power jack for safety. When the power plug 100 is pulled out, the second connecting pole 24 and the third connecting pole 26 are firstly disconnected from the jack before the first connecting pole 22 is disconnected, thereby preventing a user from getting an electric shock.

Figure 3:
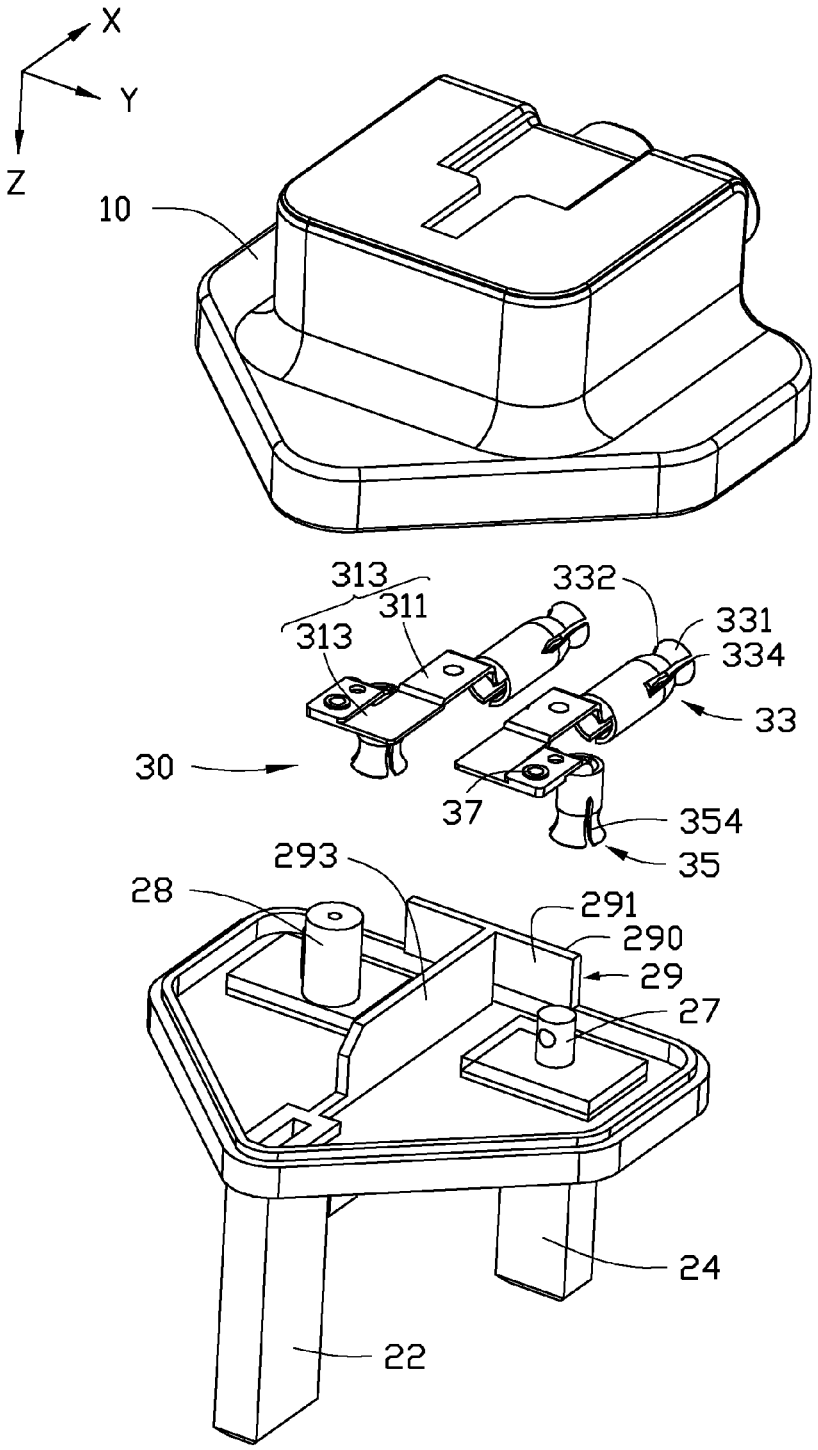
FIG. 3 is an exploded, isometric view of the power plug of FIG. 1, viewed from a second direction.

Referring to FIG. 3, an exploded, isometric view of the power plug 100 viewed from a second direction is shown. A first connecting terminal 27 and a second connecting terminal 28 are defined on a surface of the upper case 20 facing the lower case 10. The first connecting terminal 27 is electrically connected to the second connecting pole 24, and the second connecting terminal 28 is electrically connected to the third connecting pole 26. In the embodiment, the second connecting pole 24 and the third connecting pole 26 pass through the upper case 20 and extend into the receiving space to form the first connecting terminal 27 and the second connecting terminal 28, respectively. The first and second connecting terminals 27, 28 may be column shaped protrusions.

The upper case 20 further defines a resisting member 29 located on a surface of the upper case 20 facing to the lower case 10, and includes a resisting surface 290 extending from the upper case 20 to resist against the conductive resilient sheets 30. In this embodiment, the resisting member 29 is "T" shaped, and includes a resisting wall 291 and a spacing wall 293 intersecting with the resisting wall 291. The resisting wall 291 extends from an edge of the upper case 20. The spacing wall 293 extends from the center of the resisting wall 291 and is located between the first and second connecting terminals 27, 28. The resisting wall 291 defines the resisting surface 290 resisting against the two conductive resilient sheets 30 to prevent the conductive resilient sheets 30 from slipping out of the lower case 10. The spacing wall 293 is insulatively space apart the two conductive resilient sheets 30 from each other.

Figure 4:
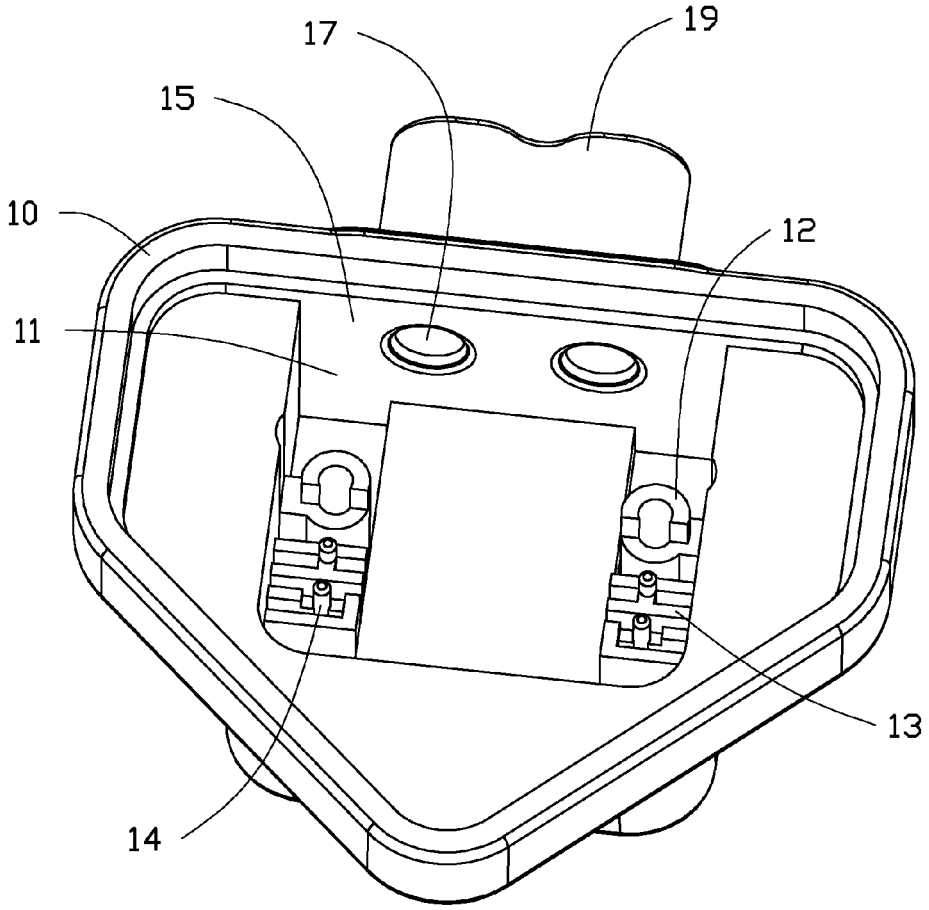
FIG. 4 is an enlarged view of the lower case of FIG. 2.

Referring to FIG. 4, an enlarged view of the lower case 10 of FIG. 2 is shown. The shape and dimension of the lower case 10 match with that of the upper case 20. A receiving groove 11 is defined in an inner space of the lower case 10. Two extrusive stands 12 are defined and extended from the bottom of the receiving groove 11 corresponding to the first and second connecting terminals 27, 28 to support the conductive resilient sheets 30. A fixing member 13 is defined on the bottom of the receiving groove 11 near each extrusive stand 12 to fix a corresponding conductive resilient sheet 30 to the lower case 10. In the embodiment, the fixing members 13 are protrusions extending from the bottom of the lower case 10. At least one fastening member 14 is formed on each of the fixing members 13 to fix the corresponding conductive resilient sheet 30 to the lower case 10. In this embodiment, two fastening members 14 are defined on each of the fixing members 13, which are screw posts. The fastening member 14 may be any kind of screw posts, such as screw bolts or screw nuts. A sidewall 15 of the receiving groove 11 near the resisting member 29 defines two through holes 17 running through the sidewall 15. Two outputting cavities 19 corresponding to the two through holes 17 are defined on the lower case 10. The two outputting cavities 19 communicate with the two through holes 17, correspondingly. The outputting cavities 19 connect to an external device (not labeled) through a pair of connecting wires to transport electrical power applied on the second connecting pole 24 and the third connecting pole 26 to the external device.

Each conductive resilient sheet 30 includes a connecting portion 31, a first conductive member 33 defined at one end of the connecting portion 31, and a second conductive member 35 defined at another opposite end of the connecting portion 31. The first conductive member 33 is fixed to the connecting portion 31 along a first direction, and is received in the outputting cavity 19 through the through hole 17 to connect the external device. The second conductive member 35 is fixed to the connecting portion 31 along a second direction perpendicular to the first direction to electrically connect to the first connecting terminal 27 or the second connecting terminal 28. The first direction is the positive direction of an X axis (as shown in FIG. 2-3), and the second direction is the positive direction of a Z axis (as shown in FIG. 2-3). In the embodiment, the second conductive members 35 are sleeve shaped, and the first and second connecting terminals 27, 28 are respectively sleeved into and electrically connected to the second conductive members 35. In other embodiments, the second conductive members 35 may be connected to the connecting terminals 27, 28 by other connecting means. For example, surfaces of the second conductive members 35 may be respectively contacted with surfaces of the first and second connecting terminals 27, 28, thereby establishing connection between the second conductive members 35 and the first and second connecting terminals 27, 28.

The connecting portion 31 includes a first connecting section 311 and a second connecting section 313. The first connecting section 311 is connected with the first conductive member 33. The second connecting section 313 is connected with the second conductive member 35. The first connecting section 311 is perpendicular to the second connecting section 313 to form an "L" shape. A locking member 37 corresponding to the fastening member 14 is defined on the second connecting section 313 to fix a corresponding conductive resilient sheet 30 to the lower case 10. A resilient sheet 315 is connected between the second connecting section 313 and the second conductive member 35. The resilient sheet 315 is deformed when the second conductive member 35 is sleeved on the first connecting terminal 27 or the second connecting terminal 28.

In the embodiment, the first conductive member 33 is cylinder shaped. The first conductive member 33 includes a first cylindrical part 330 and a first output port 331 connected to the first cylindrical part 330. One end of the first cylindrical part 330 is connected to the first connecting section 311. Another end of the first cylindrical part 330 is connected to the first output port 331. A first waist portion 332 is defined on the first output port 331 to connect with the first cylindrical part 330. In this embodiment, the diameter of the first waist portion 332 is less than that of the first cylindrical part 330 and that of the first output port 331. Using the first output port 331 and the first waist portion 332, the first conductive member 33 can be more firmly sleeved on other components, e.g., wires or cylindrical conductive terminals. Further, at least one first slit 334 is defined to pass through the first output port 331, the first waist portion 332 and a part of the first cylindrical part 330 along the length direction of the first conductive member 33. In the embodiment, the number of the first slit 334 is three to divide one end of the first conductive member 33 away from the first connecting section 311 into three parts. Thus, the inner diameter of the first conductive member 33 can be adjusted to facilitate inserting other components therein. In other embodiments, the number of the at least one first slit 334 may be two or more than three.

The structure of the second conductive member 35 is similar to that of the first conductive member 33. The second conductive member 35 includes a second cylindrical part 350 and a second output port 351 connected to the second cylindrical part 350. One end of the second cylindrical part 350 is connected to the second connecting section 313. Another end of the second cylindrical part 350 is connected to the second output port 351. A second waist portion 352 is defined on the second output port 351 to connect with the second cylindrical part 350. In this embodiment, the diameter of the second waist portion 352 is less than that of the cylindrical part 350 and that of the second output port 351.

In other embodiments, the first conductive member 33, the second conductive member 35 and the connecting portion 31 can be integrated. The second conductive members 35 are correspondingly connected to the first connecting terminal 27 and the second connecting terminal 28. The first conductive members 33 are correspondingly received in the outputting cavities 19 to connect the external device. The connecting portion 31 connects between the first conductive member 33 and the second conductive member 35.

Figure 5:
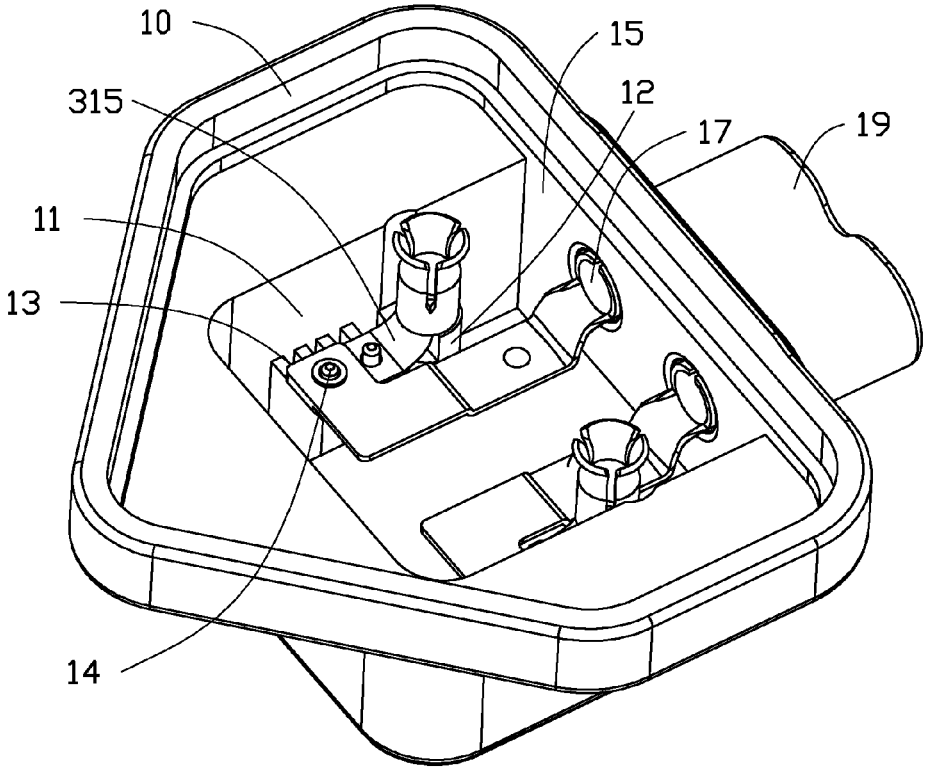
FIG. 5 is an assembled, isometric view of FIG. 2, showing the conductive resilient sheets of FIG. 2 assembled to the lower case.
Figure 6:
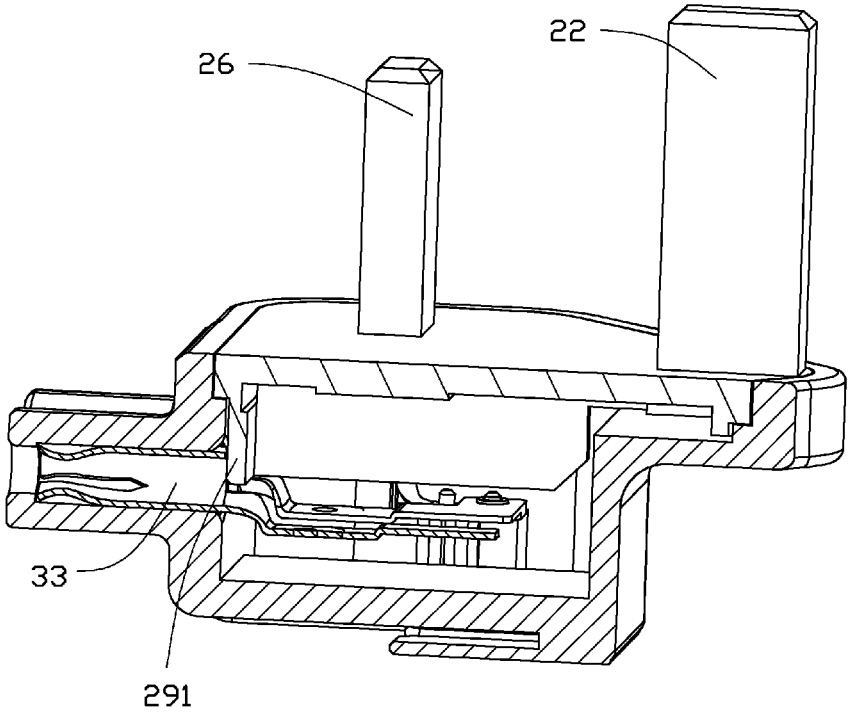
FIG. 6 is a cutaway view of FIG. 1.

Referring to FIGS. 5-6, an assembled, isometric view of FIG. 2 and a cutaway view of FIG. 1 are shown. In assembly, the two conductive resilient sheets 30 are located in the receiving groove 11 of the lower case 10, the first conductive member 33 of each conductive resilient sheet 30 is received in the outputting cavity 19 through a corresponding through hole 17, and the second conductive member 35 of each conductive resilient sheet 30 resists the extrusive stand 12. Then, the fastening member 14 of the fixing member 13 is engaged with the locking member 37 of the conductive resilient sheet 30 to fix the conductive resilient sheet 30 to the lower case 10. The upper case 20 is latched with the lower case 10 to make the first connecting terminal 27 and the second connecting terminal 28 of the upper case 20 being correspondingly received in the two second conductive members 35. The resisting wall 291 of the upper case 20 is fastened to the sidewall 15 of the lower case 10 and resists the first conductive members 33 of the conductive resilient sheets 30, to prevent the first conductive members 33 from slipping out of the through holes 17. Thus, the power plug 100 is completely assembled.

In the embodiment of the present disclosure, the conductive resilient sheets 30 of the power plug 100 are electrically connected to the second connecting pole 24 and the third connecting pole 26 of the upper case 20, to conduct the voltage applied to the two connecting poles 24, 26 to the external device. Thus, previous means of jointing the connecting wires and the first, second, and third connecting poles 22, 24, 26 of the power plug 10 are not needed any more. And since the conductive resilient sheets 30 replace the connecting wires, the assemble of the power plug 100 is more convenient.

While various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A power plug for connecting with a power outlet, the power plug comprising:

an upper case;

a lower case coupled with the upper case to define a receiving space;

at least two metal connecting poles formed on the upper case to connect to the power outlet;

two outputting cavities defined in the lower case and configured to connect an external device through a pair of connecting wires; and two conductive resilient sheets received in the receiving space;

wherein the at least two metal connecting poles pass through the upper case and extend into the receiving space to form two connecting terminals protruding from a surface of the upper case facing to the lower case, a part of each conductive resilient sheet is received in a corresponding outputting cavity and another part of each conductive resilient sheet is connected to a corresponding connecting terminal to conduct electrical power from the power outlet to the external device.

2. The power plug of claim 1, wherein each conductive resilient sheet comprises a connecting portion, a first conductive member is defined at one end of the connecting portion, and a second conductive member is defined at another opposite end of the connecting portion, the first conductive member is received in a corresponding outputting cavity to connect to the external device, and the second conductive member is electrically connected to a corresponding connecting terminal.

3. The power plug of claim 2, wherein the first conductive member is fixed to the connecting portion along a first direction, and the second conductive member is fixed to the connecting portion along a second direction perpendicular to the first direction.

4. The power plug of claim 3, wherein the connecting portion further fixes a corresponding conductive resilient sheet to the lower case, the connecting portion comprises a first connecting section connected with the first conductive member and a second connecting section connected with the second conductive member, and the first connecting section is perpendicular to the second connecting section.

5. The power plug of claim 4, wherein the first conductive member comprises a first cylindrical part and a first output port connected to the first cylindrical part, one end of the first cylindrical part is connected to the first connecting section, another end of the first cylindrical part is connected to the first output port, and a first waist portion is defined on the first output port to connect with the first cylindrical part.

6. The power plug of claim 5, wherein a diameter of the first waist portion is less than that of the first cylindrical part and that of the first output port.

7. The power plug of claim 6, wherein at least one first slit is defined to pass through the first output port, the first waist portion and a part of the first cylindrical part along a length direction of the first conductive member.

8. The power plug of claim 7, wherein the first output port defines three first slits, and one end of the first conductive member away from the first connecting section is divided into three parts by the three first slits.

9. The power plug of claim 2, wherein the first conductive member, the second conductive member and the connecting portion are integrated.

10. The power plug of claim 1, wherein a resisting member is defined on a surface of the upper case opposite to the lower case, the resisting member comprises a resisting wall extending from an edge of the upper case and a spacing wall intersection with the resisting wall, the spacing wall extends from the center of the resisting wall and is located between the two connecting terminals, the resisting wall defines a resisting surface resisting against the two conductive resilient sheets to prevent the conductive resilient sheets from slipping out of the lower case, and the spacing wall is insulative the two conductive resilient sheets from each other.

11. A power plug for connecting with a power outlet, the power plug comprising:

an upper case;

a lower case coupled with the upper case to define a receiving space;

at least two metal connecting poles formed on the upper case to connect to the power outlet;

two outputting cavities defined in the lower case and configured to connect an external device through a pair of connecting wires;

two conductive resilient sheets received in the receiving space; and two fixing members protruding extending from a bottom of the lower case to threadedly engage with the two conductive resilient sheets to fix the conductive resilient sheets to the lower case;

wherein the at least two metal connecting poles pass through the upper case and extend into the receiving space to form two connecting terminals protruding from a surface of the upper case facing to the lower case, each conductive resilient sheet connects between a corresponding outputting cavity and one of the two connecting terminals to conduct electrical power from the power outlet to the external device.

12. The power plug of claim 11, wherein each conductive resilient sheet comprises a connecting portion, a first conductive member is defined at one end of the connecting portion, and a second conductive member is defined at another opposite end of the connecting portion, the first conductive member is received in a corresponding outputting cavity to connect to the external device, and the second conductive member is electrically connected to a corresponding connecting terminal.

13. The power plug of claim 12, wherein the first conductive member is fixed to the connecting portion along a first direction, and the second conductive member is fixed to the connecting portion along a second direction perpendicular to the first direction.

14. The power plug of claim 13, wherein the connecting portion further fixes a corresponding conductive resilient sheet to the lower case, the connecting portion comprises a first connecting section connected with the first conductive member and a second connecting section connected with the second conductive member, and the first connecting section is perpendicular to the second connecting section.

15. The power plug of claim 14, wherein the first conductive member comprises a first cylindrical part and a first output port connected to the first cylindrical part, one end of the first cylindrical part is connected to the first connecting section, another end of the first cylindrical part is connected to the first output port, and a first waist portion is defined on the first output port to connect with the first cylindrical part.

16. The power plug of claim 15, wherein a diameter of the first waist portion is less than that of the first cylindrical part and that of the first output port.

17. The power plug of claim 16, wherein at least one first slit is defined to pass through the first output port, the first waist portion and a part of the first cylindrical part along a length direction of the first conductive member.

18. The power plug of claim 17, wherein the first output port defines three first slits, and one end of the first conductive member away from the first connecting section is divided into three parts by the three first slits.

19. The power plug of claim 12, wherein the first conductive member, the second conductive member and the connecting portion are integrated.

20. The power plug of claim 11, wherein a resisting member is defined on a surface of the upper case opposite to the lower case, the resisting member comprises a resisting wall extending from an edge of the upper case and a spacing wall intersection with the resisting wall, the spacing wall extends from the center of the resisting wall and is located between the two connecting terminals, the resisting wall defines a resisting surface resisting against the two conductive resilient sheets to prevent the conductive resilient sheets from slipping out of the lower case, and the spacing wall insulates the two conductive resilient sheets from each other.

* * * * *